United States Patent [19]

Attenni

[11] Patent Number: 4,591,156

[45] Date of Patent: May 27, 1986

[54] REMOVABLE DEVICE FOR ATTACHING A RACKET TO A PLAYER'S WRIST

[76] Inventor: Maurizio Attenni, Via Monte Zebio, 32, Roma 00195, Italy

[21] Appl. No.: 675,242

[22] Filed: Nov. 26, 1984

[51] Int. Cl.[4] ..... A63B 49/08

[52] U.S. Cl. ..... 273/73 J; 24/606; 24/265 R

[58] Field of Search ..... 273/189 A, 81 R, 81.4, 273/162, 75, 73 J, 73 R, 29 A, 29 R, 67 R, 81 D, 165, 166, 84 R, 58 C; 272/75; 280/821, 822, 606, 602, 591, 265 R, 265 AL; 24/606, 265 R

[56] References Cited

U.S. PATENT DOCUMENTS

| | | | |
|---|---|---|---|
| 3,540,751 | 11/1970 | Pierce | 280/822 |
| 3,685,850 | 8/1972 | Kepka et al. | 280/821 |
| 3,995,872 | 12/1976 | Joseph | 273/81 D |
| 4,247,975 | 2/1981 | Robinson | 273/73 J |
| 4,265,448 | 5/1981 | Anderson | 273/75 X |

FOREIGN PATENT DOCUMENTS

| | | | |
|---|---|---|---|
| 443206 | 2/1936 | United Kingdom | 273/73 J |

*Primary Examiner*—Richard C. Pinkham
*Assistant Examiner*—Matthew L. Schneider
*Attorney, Agent, or Firm*—Young & Thompson

[57] ABSTRACT

Removable device for attaching a racket to a player's wrist, comprises a flexible wrist strap that encircles the player's wrist, and a soft rubber cap that grips the end of the handgrip and has a rigid female insert that releasably retains a male assembly on the wrist strap. For this purpose, the insert has a central opening for receiving a portion of the male assembly, that central opening having an abutment shoulder that faces inwardly. The male assembly comprises a fitting having an annular flange that nests in the cap, and a cylindrical rod that slides in the fitting. The cylindrical rod has an enlarged conical inner end, which spreads apart or permits to move back toward each other, legs on the fitting that have outwardly extending detents. When the legs are spread, the detents cannot clear the abutment shoulder and so the device is held assembled. When the rod is pushed in and the legs can move back together, the detents are sufficiently closely spaced to clear the abutment shoulder. The two positions of the rod are determined and maintained by a pin on the rod that rides in a slot in the fitting, and is selectively held out of the slot by an annular ledge on the fitting. The cap is of soft rubber and has a truncated conical sleeve to grip the end of the handgrip of the racket.

8 Claims, 8 Drawing Figures

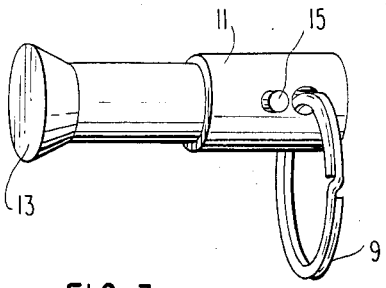
FIG. 3
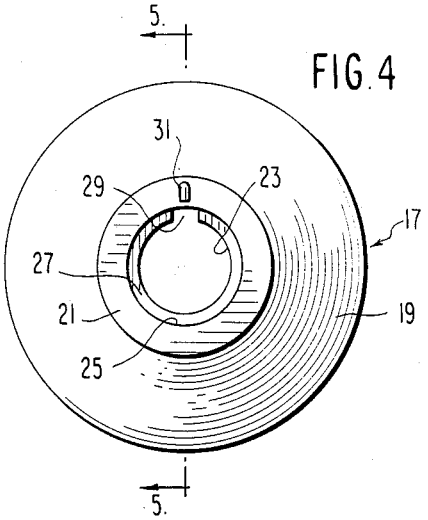
FIG. 4
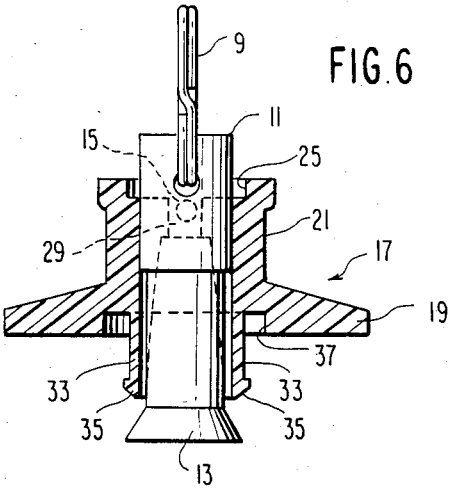
FIG. 6
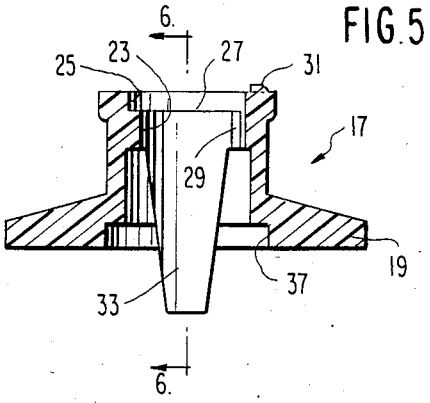
FIG. 5
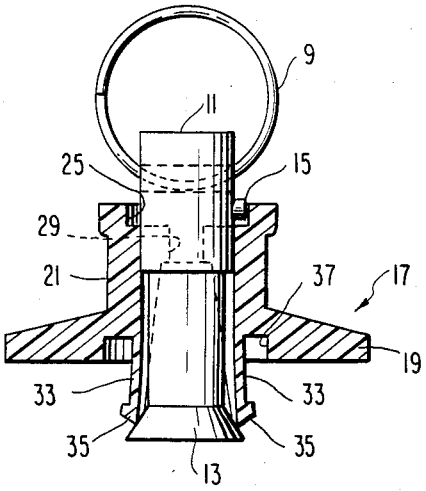
FIG. 7
FIG. 8
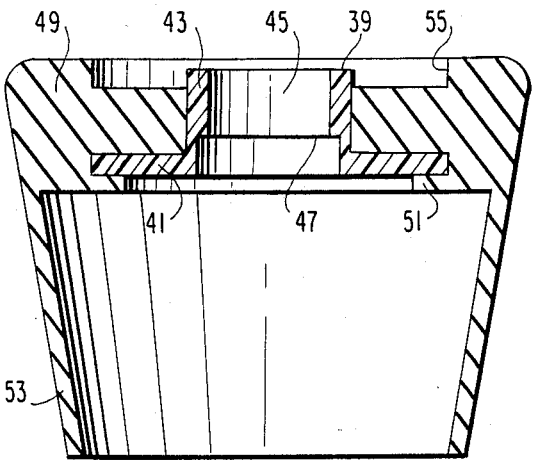

REMOVABLE DEVICE FOR ATTACHING A RACKET TO A PLAYER'S WRIST

The present invention relates to a removable device for attaching a racket to a player's wrist, more particularly by means of a strap that encircles the player's wrist and is removably secured to a cap that in turn is removably secured to the handle of the racket.

The present invention is useful in all games played with a racket, such as tennis, racketball, paddle ball, etc., but will be illustrated by way of example in connection with a tennis racket.

It is accordingly an object of the present invention to provide a removable device for attaching a racket to a player's wrist, such that the racket will not slip out of the player's grip.

Another object of the present invention is the provision of such a device, which gives the player a better grip on the racket.

Still another object of the invention is the provision of such a device, which tends to lessen the impact on the player's arm upon striking the ball with the racket.

Finally, it is an object of the present invention to provide such device, which will be relatively simple and inexpensive to manufacture, easy to install and operate, and rugged and durable in use.

Other objects, features and advantages of the present invention will become apparent from a consideration of the following description, taken in connection with the accompanying drawings, in which:

FIG. 3 is a perspective view of the reciprocable rod that comprises the actuating member of the device;

FIG. 4 is an end view of the fitting in which the rod of FIG. 3 reciprocates;

FIG. 5 is a cross-sectional view taken on the line 5—5 of FIG. 4;

FIG. 6 is a cross-sectional view taken on the line 6—6 of FIG. 5 but with the rod of FIG. 3 in place;

FIG. 7 is a view similar to FIG. 6 but showing another position of the parts, the parts in their FIG. 6 position being in the unlocking condition and in FIG. 7 in the locking condition; and FIG. 8 is a cross-sectional view showing the cap and the insert that centrally receive respectively the end of the racket handle and the assembly shown in FIGS. 6 and 7.

Figure 1:
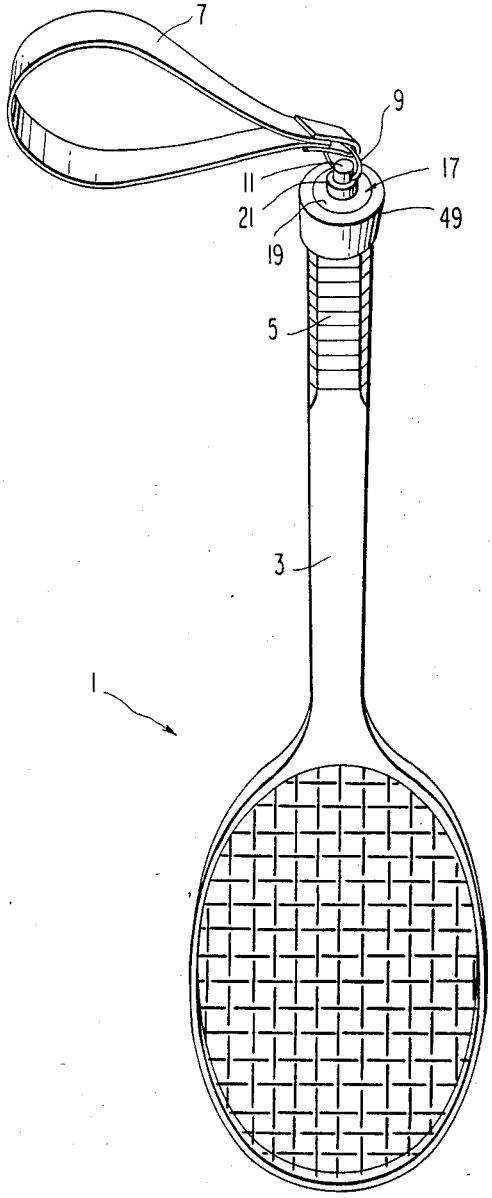
FIG. 1 is a perspective view of a tennis racket provided with a device according to the present invention.

Referring now to the drawings in greater detail, and first to FIG. 1 thereof, there is shown a conventional tennis racket 1 having a conventional handle 3 and handgrip 5. A wrist strap 7 is provided, of any flexible material, for encircling the wrist of the user during play.

Strap 7 is secured to a ring 9 (which of course could have any of a variety of shapes other than circular) which is freely swingably received through a hole in an end of a generally cylindrical rod 11 best seen in FIG. 3. Rod 11 has an enlarged conical end 13 at its end opposite ring, and a pin 15 that projects radially outwardly from rod 11 adjacent the same end as ring 9.

Rod 11 is slidably received within a fitting 17 whose details are best seen in FIGS. 4 and 5. Fitting 17, which is of rigid material such as metal or plastic, and is preferably molded from plastic for reasons of economy, has a radially outwardly projecting flange 19 and an upstanding cylindrical boss 21 that is traversed by a passageway 23. The outer end of passageway 23 is enlarged by a counterbore 25 which thus provides a ledge 27 disposed in a plane perpendicular to the axis of fitting 17. Counterbore 25 is extended axially at one point by a slot 29 recessed in a side wall of passageway 23; and because slot 29 will be hidden in use, a locator lug 31 is provided on the outer edge of boss 21 in registry with slot 29 to enable the user to locate slot 29.

Fitting 17 is extended downwardly as seen in FIG. 5, by a pair of diametrically spaced legs 33 molded integrally therewith and having confronting internal surfaces that are continuations of the cylindrical internal surface of passageway 23. Each leg 33 terminates in an outwardly extending detent 35 for a purpose to be explained. A recess 37 in the underside of fitting 17 gives to the legs 33 a longer length and hence makes them more pliable, without increasing the overall axial length of fitting 17. The reason for rendering the legs 33 pliable will be explained hereinafter.

Fitting 17, with rod 11 disposed therein, is releasably retained in an insert 39 which is of rigid material such as metal or plastic, and again is preferably molded of plastic for economy. Insert 39 comprises at its inner side an annular flat rim 41 that extends radially outwardly, and an upstanding generally cylindrical sleeve 43 that has a central opening 45 therethrough. The upper end of sleeve 43 is of smaller internal diameter than the lower end, the portions of two different diameters being separated by an abutment shoulder 47 that faces downwardly as best seen in FIG. 8, and is disposed in a plane perpendicular to the axis of insert 39.

A cap 49 of soft resiliently deformable material such as plastic or rubber, preferably molded rubber, surrounds insert 39. The lower portion of cap 49, as seen in FIG. 8, is largely occupied by a recess for reception of the end of the handgrip 5 of the racket. This recess has on its upper side an annular lip 51 which retains insert 39 within cap 49 by underlying and locking rim 41 in the position shown in FIG. 8. There is no reason ever to remove insert 39 from within cap 49; and so the retention of insert 39 in cap 49 can be as permanent as desired.

The recess of cap 49 for reception of the end of the handgrip 5, is bordered laterally by a skirt 53 of one piece with the rest of cap 49, and hence of relatively deformable rubber or the like. In its undeformed condition, skirt 53 is of truncated conical configuration, so that it will stretch over the end of handgrip 5 and be retained thereon by the combined action of its resiliency and its high coefficient of friction.

On its upper side as seen in FIG. 8, cap 49 has a shallow circular recess 55 for the reception of flange 19 of fitting 17. The upper end of sleeve 43 projects a short distance above the bottom of shallow recess 55, as seen in FIG. 8, and in the assembled position of the parts fits snugly into recess 37 on the underside of fitting 17.

Referring now more particularly to FIGS. 6 and 7, it is to be understood that rod 11 is in permanent assembly with fitting 17. For this purpose, ring 9 is of the split ring type or other type that can be assembled on rod 11 after rod 11 is assembled with fitting 17. Thus, with ring 9 removed, rod 11 is inserted from below into fitting 17 until its upper end protrudes above boss 21, after which ring 9 is added and the permanent assembly is completed.

Comparing FIGS. 6 and 7, it will be seen that the assembly shown therein has two positions, one in which the legs 33 are undeformed and so the detents 35 are as close together as possible, as seen in FIG. 6, and the other in which the rod 11 has been moved upwardly relative to fitting 17, so that conical lower end 13 contacts the lower ends of legs 33 to cam them outwardly thereby to position detents 35 more widely spaced apart, as seen in FIG. 7.

Figure 2:
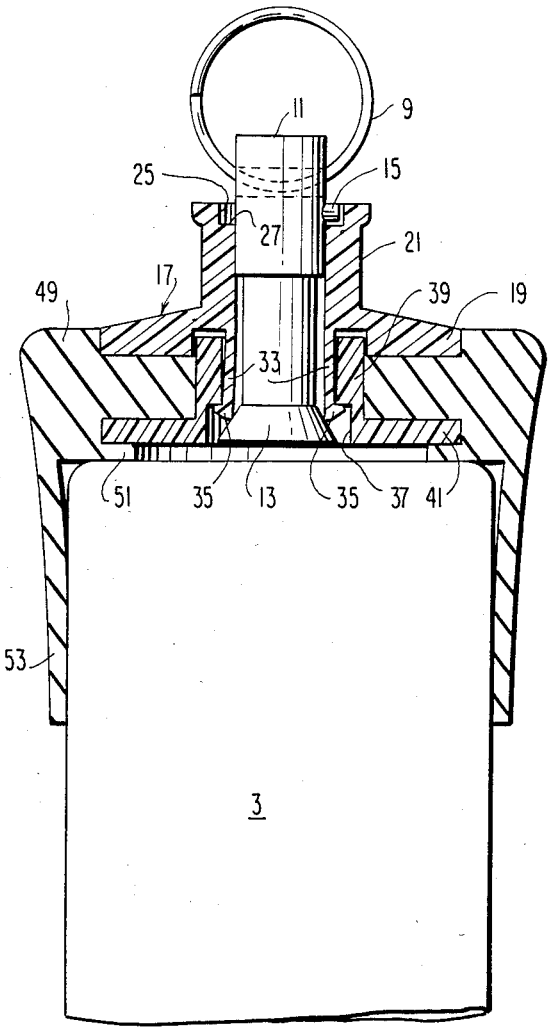
FIG. 2 is an enlarged fragmentary cross-sectional view of the device attached to the end of the handle of a racket.

In the FIG. 6 position, the detents 35 are sufficiently close together, that the assembly in the position shown in FIG. 6, can be freely inserted within and removed from the central opening 45 of insert 39. But in the FIG. 7 position of the parts, the detents 35 are spaced so far apart that if it is attempted to remove the assembly of FIG. 7 from within insert 39, then the detents 35 engage under the abutment shoulder 47 and prevent this removal. This is also the position of the parts shown in FIG. 2.

Conversely, when rod 11 is pushed downwardly from its FIG. 7 position to its FIG. 6 position, the natural resiliency of the legs 33 is such as to bring them together, thereby to move detents 35 toward each other a distance sufficient to clear abutment shoulder 47 thereby to permit removal of the assembly of FIGS. 6 and 7 from within insert 39.

The two positions of FIGS. 6 and 7 are predetermined and maintained by the pin 15, the ledge 27 and the slot 29. Notice that in FIG. 6, pin 15 is shown to the right of rod 11; but in FIG. 7, pin 15 is shown to the left of rod 11. This means that rod 11 has been rotated 90° between its FIG. 6 and FIG. 7 positions. In its FIG. 7 position, pin 15 rides on ledge 27, which accordingly maintains the detents 35 widely spaced and so prevents disassembly of the device. Only when rod 11 is rotated to the position that pin 15 can enter into slot 29 and move downwardly in slot 29 to the FIG. 6 position, will the detents 35 be brought sufficiently close together to permit disassembly of the device. As pointed out above, lug 31 marks the position of slot 29; and in the FIG. 7 or locked position of the device, both the pin 15 and the lug 31 are visible to the user. To unlock the device, therefore, the user need only rotate rod 11 (for which purpose ring 9 provides a good fingergrip) until pin 15 and lug 31 align with each other, after which the rod 11 can be pushed inwardly, that is, toward the racket, to the FIG. 6 position. The assembly of FIGS. 6 and 7 can then be withdrawn endwise from the assembly of FIG. 8, which separates the strap and its permanently attached parts, from the cap 49 and insert 39, which can be left on the racket because they do not noticeably alter the weight or balance or playing characteristics of the racket.

It is thus possible to use the device of the present invention very quickly, or not, as desired, by leaving the cap 49 and its contained insert 39 on the end of the handgrip, attaching or removing the strap 7 and its attached parts quickly and easily as desired. When attached, that is, when the parts are in the assembled position of FIG. 2, it will be noted that any tension exerted between the strap and the racket, must be transmitted by the relatively flexible and resilient cap 49. This has the advantage of absorbing what might otherwise be shocks transmitted to the playing arm of the player, and also providing an additional but yieldable connection with the racket, via the player's wrist.

This relatively yieldable connection between the strap and the racket, however, does not in any way impair the securement of the racket to the player's wrist via the strap, to keep the racket from slipping out of the player's hand, because the cap 49, although deliberately removable from the end of handgrip 5, is nevertheless sufficiently securely held thereon by the resiliency of skirt 53 and its coefficient of friction, mentioned above, as to resist even a relatively strong pull by the racket on the strap.

To use the device, with the parts disassembled, the player simply rotates rod 11 until pin 15 is aligned with lug 31 (and hence with slot 29) and then presses inwardly on rod 11 until pin 15 is seated deep in slot 29. This is the FIG. 6 position. The male assembly can then be inserted into the female assembly comprised by the insert 39, after which the player pulls back on rod 11 and rotates it until the pin 15 is out of alignment with slot 29 and hence rides on ledge 27. This is the FIG. 7 position of the parts, and also the fully assembled and locked position of FIG. 2, in which the device cannot be disassembled and the wrist strap and the racket are securely interconnected. Ledge 27 thus prevents rod 11 from being moved inwardly to the disassembly position of FIG. 6, throughout the use of the device by the player. Disassembly is of course performed in the reverse order.

From a consideration of the foregoing disclosure, therefore, it will be evident that the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

I claim:

1. Removable device for attaching a racket having a handgrip to a player's wrist, comprising a flexible strap adapted to encircle the player's wrist, a cap of elastic material adapted to be mounted grippingly on the end of the handgrip of a racket, female means carried by the cap, and male means carried by the strap and adapted to be releasably retained within said female means, said cap containing a rigid hollow insert providing said female means, said male means having two positions within said insert, in one of which positions said male means can be freely inserted into and withdrawn from said insert, and in the other of which positions said male means is secured in said insert.

2. Device as claimed in claim 1, said cap having a base that receives said insert and a truncated conical skirt that surrounds and grippingly engages the end of the handgrip of a racket.

3. Device as claimed in claim 1, said male means comprising a fitting, and a rod slidable in said fitting toward and away from the racket, the fitting having means thereon actuable by said rod to move said male means between said two positions.

4. Device as claimed in claim 3, and means directly connecting said strap only to said rod.

5. Device as claimed in claim 3, said fitting having legs thereon between which said rod slides, said legs having detent means thereon selectively engageable with said insert, said rod having means thereon adapted upon sliding movement of said rod within said insert, to move said detent means into and out of engagement with said insert thereby to move said male means between said two positions.

6. Device as claimed in claim 5, said fitting having a slot therein extending lengthwise of said rod, said rod having a pin thereon adapted to ride in said slot in one rotated position of said rod, and means maintaining said pin in such a position that said rod moves said detents apart and into engagement with said insert, in all rotated positions of said rod other than said one position.

7. Device as claimed in claim 6, and visible indicator means for locating said slot.

8. Device as claimed in claim 3, said cap having a shallow circular recess therein, said fitting having an annular flange that nests in said shallow recess of the cap, said insert projecting above the bottom of said shallow recess and into said fitting within said annular flange.

* * * * *